US007676045B2

(12) United States Patent
Merrey et al.

(10) Patent No.: US 7,676,045 B2
(45) Date of Patent: Mar. 9, 2010

(54) MOUNTABLE SPEAKER ASSEMBLY

(75) Inventors: F. Davis Merrey, Piedmont, OK (US); Bernard W. Baker, Herkimer, NY (US)

(73) Assignee: Altec Lansing, LLC, Milford, PA (US)

( * ) Notice: Subject to any disclaimer, the term of this patent is extended or adjusted under 35 U.S.C. 154(b) by 1135 days.

(21) Appl. No.: 11/288,450

(22) Filed: Nov. 29, 2005

(65) Prior Publication Data

US 2007/0121988 A1 May 31, 2007

(51) Int. Cl.
*H04R 1/02* (2006.01)

(52) U.S. Cl. ..... 381/87; 381/386; 381/395

(58) Field of Classification Search ..... 381/87, 381/385, 386, 388, 395; 181/150
See application file for complete search history.

(56) References Cited

U.S. PATENT DOCUMENTS 7,334,767 B2 * 2/2008 Wright ..... 381/386
7,401,681 B2 * 7/2008 Iwayama et al. ..... 181/150

* cited by examiner

*Primary Examiner*—Brian Ensey
(74) *Attorney, Agent, or Firm*—Greenberg Traurig LLP

(57) ABSTRACT

Embodiments of a speaker assembly and cooperating suspension ring designed to allow installation of the assembly in a horizontal ceiling tile from below are disclosed. The speaker assembly includes a body or housing with a flange at one end. The body has a diameter that allows it to fit through a hole the ceiling tile and the suspension ring. The assembly is further provided with clamps attached to the flange next to the body. In order to bring the flange into contact with the ceiling tile, the assembly must be aligned so that the clamps penetrate cooperating voids in the suspension ring. The assembly is then rotated in a direction depending on the tile thickness and lowered into a position where the clamps engage with projections on the suspension ring so that the suspension ring supports the weight of the assembly.

34 Claims, 5 Drawing Sheets

MOUNTABLE SPEAKER ASSEMBLY

This application includes material which is subject to copyright protection. The copyright owner has no objection to the facsimile reproduction by anyone of the patent disclosure, as it appears in the Patent and Trademark Office files or records, but otherwise reserves all copyright rights whatsoever.

FIELD OF THE INVENTION

Various embodiments of the present invention relate to mounting devices to a surface. In one example (which example is intended to be illustrative and not restrictive), the systems and methods of the present invention may be applied providing a speaker assembly for mounting to a ceiling tile. In one example (which example is intended to be illustrative and not restrictive), the systems and methods of the present invention may be applied to mounting an assembly to a ceiling tile.

BACKGROUND OF THE INVENTION

Speaker systems are commonly used in commercial and industrial buildings for a variety of purposes, including the delivery of music, for paging, and for emergency alerts. Buildings of these types are typically constructed using a drop ceiling of standard 16 millimeter (mm) thick ceiling tiles suspended on a frame. Occasionally, non-standard ceiling tile thicknesses are also used, depending on the construction. In addition, some buildings are constructed with hard ceilings, as opposed to drop ceilings.

Often, it is necessary to install such speaker systems after the construction of the building and into the existing ceiling. Typical speaker assemblies must be held in place and then fastened in some way to the ceiling. Installation of these speaker assemblies often requires an installer to climb a ladder and attempt to install a speaker assembly into the ceiling while precariously perched some height above the floor. Such installation often requires the installer to balance at the top of the ladder while using one hand to hold the speaker assembly in place and the other hand to manipulate a tool for fastening the speaker assembly to the ceiling, such as a power drill or a manual screw driver. Thus, installation of speaker assemblies can be very dangerous to installers.

SUMMARY OF THE INVENTION

Various embodiments of the present invention relate to a speaker assembly that can be suspended from a ceiling prior to being fastened to the ceiling by the installer.

In one example (which example is intended to be illustrative and not restrictive), the systems and methods of the present invention may be applied by providing a speaker assembly and cooperating suspension ring designed to allow installation of the assembly in a horizontal ceiling tile from below. A hole of a given diameter is cut in the ceiling tile and the suspension ring is placed above and concentric with the hole. The suspension ring may be C-shaped so it can be passed through the hole from below.

The speaker assembly includes a body or housing with a flange at one end. The body has a diameter that allows it to fit through the hole and the suspension ring. The assembly is further provided with clamps attached to the flange next to the body. In order to bring the flange into contact with the ceiling tile, the assembly must be aligned so that the clamps penetrate cooperating voids in the suspension ring.

After contact of the flange with the ceiling tile, the assembly is rotated and lowered into a position where the clamps engage with projections on the suspension ring so that the suspension ring supports the weight of the assembly and furthermore prevents the assembly from rotating without first being lifted again. Then the clamps of the assembly may be tightened to complete the installation the assembly into the ceiling tile.

In addition, the clamps on the assembly are designed so that rotation in one direction permits the assembly to be installed into ceiling tiles having a first thickness and rotation in the other direction permits the assembly to be installed into ceiling tiles having a different thickness.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of at least one embodiment of the invention.

In the drawings.

DETAILED DESCRIPTION OF EMBODIMENTS OF THE INVENTION

Reference will now be made in detail to illustrative embodiments of the present invention, examples of which are shown in the accompanying drawings.

Figure 1:
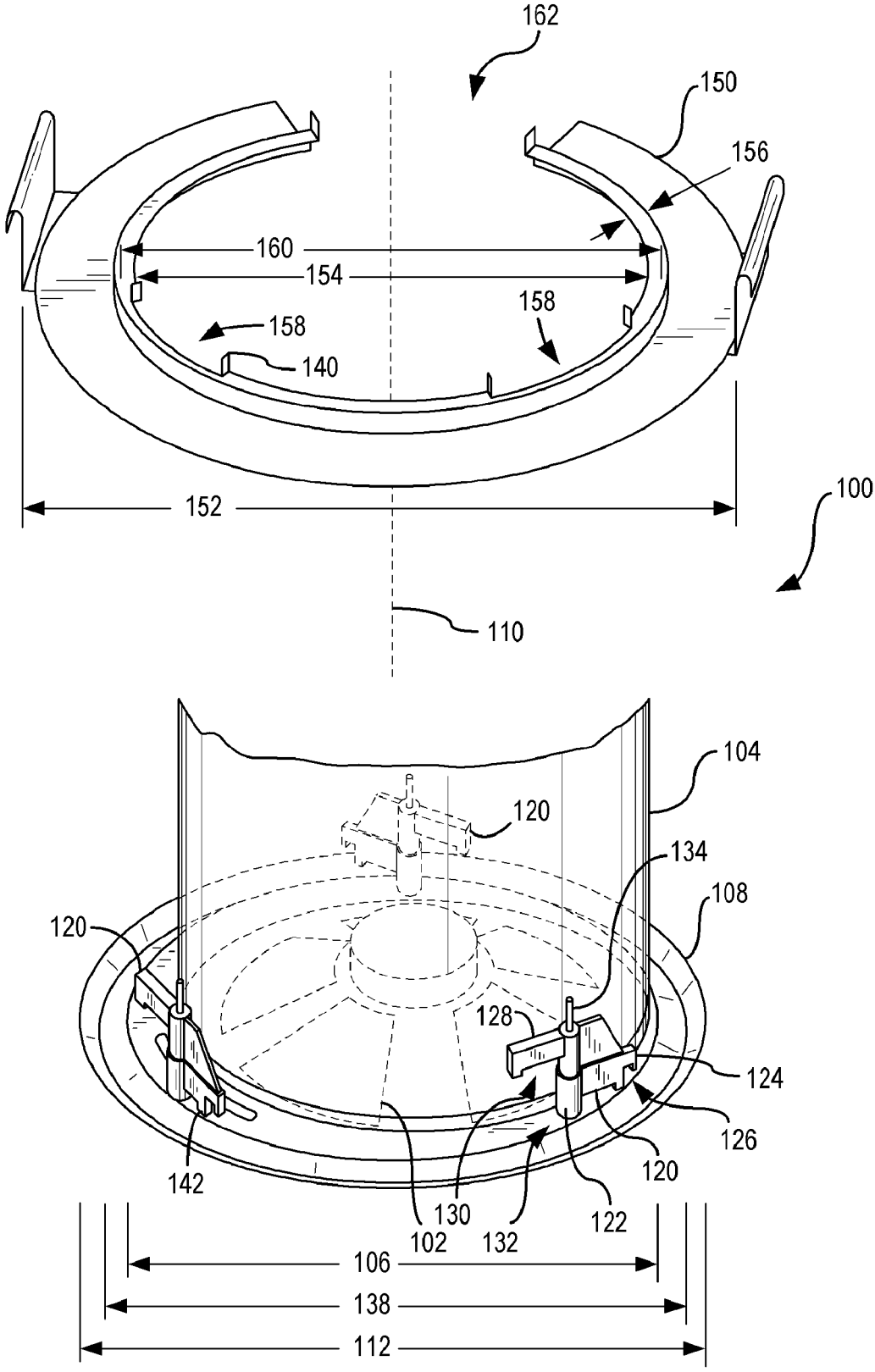
FIG. 1 is an exploded view of a speaker assembly and suspension ring in accordance with an embodiment of the present invention.

FIG. 1 is an exploded view of a speaker assembly 100 and suspension ring 150 in accordance with an embodiment of the present invention. The speaker assembly 100 includes a speaker 102 installed in a housing 104. The housing 104 is shown with a substantially cylindrical body, although this shape not necessary and in one embodiment the housing is omitted altogether. The housing 104 has two ends, the first end where the speaker 102 is installed and a second end that in the embodiment shown exposes the electronic connections for the speaker 102. The housing 104 has an outside housing diameter 106 and a length sufficient to house the speaker 102 and its associated electronics and connections.

The housing 104 is provided with a housing flange 108 on the end with the speaker 102. The housing flange 108 has a center axis 110 and an outside flange diameter 112. In an embodiment, the center of the speaker 102 may be coincide with the center axis 110 of the housing flange 108. However, in the embodiment shown the speaker 102 and the housing 104 are slightly off center of the center axis 110. In this embodiment, it will be understood that the outside housing diameter 106 is still measured relative to the center axis 110 such that the outside housing diameter 106 is equal to the twice the distance from the center axis 110 to the part of the housing 104 that is farthest from the center axis 110.

The housing flange 108 is provided with several clamps 120. In the embodiment shown, there are three clamps 120 (which example is intended to be illustrative and not restrictive). The clamps 120 shown are a roughly "T" shaped apparatus having a body 122, a first notched member 124 having a first notch 126, and a second notched member 128 having a second notch 130. The body 122 has a flange end 132 and the notched members 124, 128 are located along the body 122 at different distances from the flange end 132 for reasons that will become apparent later.

The notched members 124, 128 extend substantially perpendicularly from the body 122 and the notches 126, 130 are positioned parallel to the body 122 facing toward the flange end 132 of the body 122 as shown. In the embodiment shown, the notches 126, 130 consist of slots cut through the notched members. The notches 126, 130 are provided to receive and engage with lip-like projections 140 on the suspension ring 150 as will be described below. However other configurations of the notches 126, 130 are possible such as for example a conical notch for receiving a conic projection or an "X"-shaped notch for receiving an X-shaped projection.

In the embodiment shown, each clamps 120 is further provided with a stopper portion 142 under one of the first notched member 124. The stopper portion 142 prevents over rotation of the speaker assembly 100 when inserted into the suspension ring 150 and rotated clockwise (as seen from below). The clamp body 122 itself forms the stopper for the second notched member 128 thus preventing over rotation of the speaker assembly 100 when inserted into the suspension ring 150 rotated counter-clockwise.

The clamps 120 are moveably fixed to the housing flange 108 by means of a fastener 134. In the embodiment shown, the fastener 134 is a screw that penetrates the housing flange and the clamp 120 and is rotatably fixed to the housing flange 108. The housing flange 108 is not threaded to engage the screw but allows the screw to rotate freely without causing a change in the position of the screw parallel to the center axis 110. The clamp 120 however is threaded so that rotation of the screw causes the clamp 120 to move along an axis roughly parallel with the center axis 110 in a direction depending on the screw rotation. The screw fastener 134 is provided as an illustrative example and one skilled in the art will recognize that alternative fasteners 134 and means of moveably fastening the clamp 120 to the housing flange 108 are also possible including, for example cam-operated fasteners and spring-loaded fasteners.

Figure 6A:
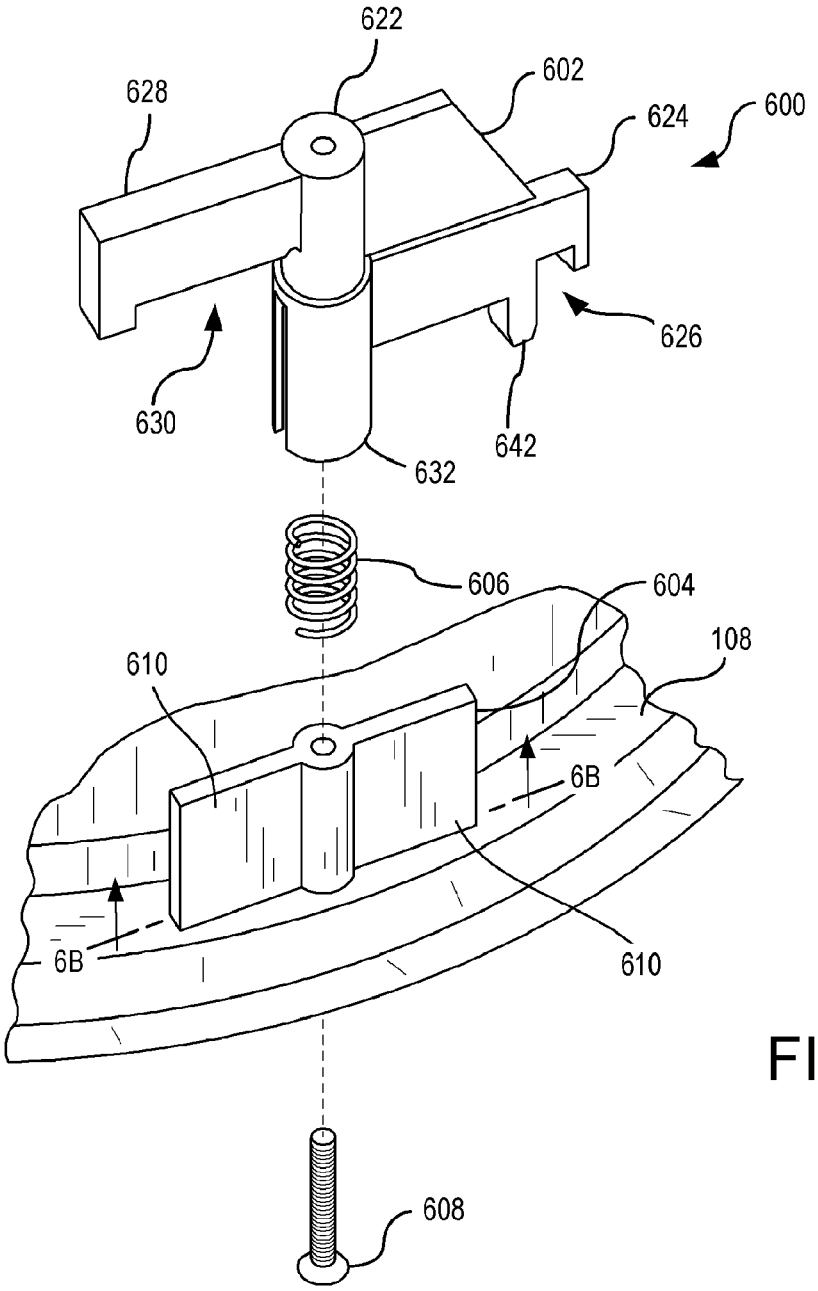
FIGS. 6A and 6B illustrate a clamp in accordance an embodiment with the present invention.
Figure 6B:
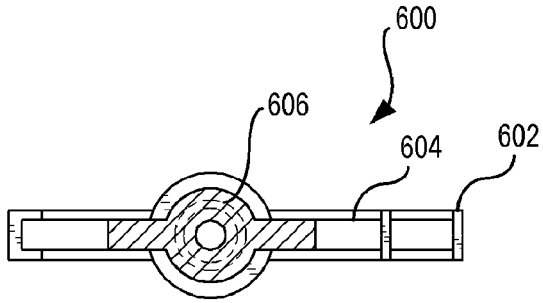

FIGS. 6A and 6B illustrate an alternative embodiment of a clamp 600. The clamp 600 includes a substantially hollow "T"-shaped member 602 and a second inner member 604 designed to penetrate the T-shaped member 602 as shown. When installed, a spring 606 is trapped between the T-shaped member 602 and the inner member 604. A fastener 608 (in the embodiment shown a screw 608) penetrates the housing flange 108, the inner member 604, the spring 606, and moveably engages the T-shaped member 602. Thus, upon rotation of the screw 608, the T-shaped member 602 is moved closer to or away from the housing flange 108. In the embodiment, the spring provides a force that drives the T-shaped member 602 and the inner member 604 apart. This spring force causes the screw 608 and the inner member 604 to sandwich the housing flange 108 and also prevents movement of the T-shaped member 602 relative to the housing flange 108 without manipulation of the screw 608.

In the embodiment shown, the T-shaped member 602 includes a hollow body 622, a first notched member 624 having a first notch 626, and a second notched member 628 having a second notch 630. The body 622 has a flange end 632 and the notched members 624, 628 are located along the body 622 at different distances from the flange end 632 for reasons that will become apparent later. The notched member 624, 628 roughly correspond in features to those described with reference to FIGS. 1 and 5, including notches 626, 630 and stopper portion 642. In this embodiment, stopper portion 642 also limits rotation of the T-shaped member 602 about the inner member 604 by providing a guide.

The inner member 604 of clamp 600 is provided with one or more fins 610 (two are shown). The fins 610 prevent movement of the T-shaped member 602 relative to the inner member 604. The fins 610 also provide a larger and more stable contact surface between the housing flange 108 and the inner member 604. In the embodiment shown, the inner member 604 is part of or permanently fixed to the housing flange 108. In another embodiment, the inner member 604 is designed to removably engage the housing flange 108 in such a way that the inner member 604 when installed cannot move relative to the housing flange 108, thereby ensuring that the T-shaped member 602 is also maintained in a desired alignment. FIG. 6B is a view from the bottom of the clamp 600 showing the T-shaped member 602 with the inner member 604 and spring 606 inserted.

Figure 5:
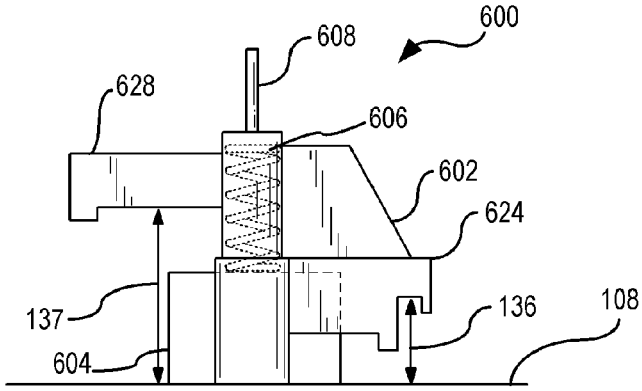
FIG. 5 is a side view of a clamp illustrating the distances between the notched members and the housing flange when the clamp is tightened to housing flange in accordance with an embodiment of the present invention.

Clamps 120 or 600 are moved through manipulation of the fasteners, for example a screw 608 as shown in FIGS. 6A and 6B, to change the distance of the clamp's notched members from the housing flange 108. Taking the embodiment shown in FIG. 6A as an example, rotation of the screw 608, then, changes the distances 136, 137 (see FIG. 5) between the notched members 624, 628 and the housing flange 108. A minimum for the distance is that distance 136 between the first notched member 624 and the flange end 632 of the clamp 120 as shown in FIG. 5. A maximum (not shown) for the distance is the distance 137 between the second notched member 628 and the flange end 632 of the clamp 600 plus the maximum displacement of the clamp 600 possible by the fastener 134.

The clamps 120 or 600 are fixed to the housing flange 108 at locations a fixed distance from the center axis 110 of the housing flange 108 so that the outside diameter 138 of the circle formed by the clamps (the clamp diameter 138) is less than the outside flange diameter 112. This allows the speaker assembly 100 to be inserted into a hole in a ceiling tile or other surface with a hole diameter greater than the clamp diameter 138. And if the hole diameter is also less than the outside flange diameter 112, then the housing flange 108 will prevent the speaker assembly from passing completely through the hole, as will be discussed in greater detail with reference to FIG. 3 below.

Turning now to the suspension ring 150, in the embodiment shown the suspension ring 150 is a roughly circular ring-shaped body having an outside diameter 152 and an inside diameter 154 and a thickness 156. Alternative shapes are possible, including square, rectangular, or "U"-shaped plates. The inside diameter 154 is at least slightly greater than the outside housing diameter 106. Portions of the inner diameter of the ring have been removed to form voids 158. The voids 158 are sized and located about the inner diameter 154 of the ring to permit the clamps 120 to pass through the ring 150 if the speaker assembly is oriented as shown in FIG. 1. Thus, at the voids the suspension ring can be considered to have a middle diameter 160 that is at least slightly greater than the clamp diameter 138.

It should be noted that in the embodiment shown, the outside diameter 152 of the suspension ring 150 is roughly equivalent to the outside flange diameter 112. However, this is not necessary and the two diameters may vary significantly as long as the relationship between the other diameters (e.g., the relationship between the middle diameter 160 and the clamp diameter 138 and the inside diameter 154 and the outside housing diameter 106) are not affected.

Each void 158 is provided with two projections 140 on opposing sides of the void 158. In the embodiment shown, the projections 140 are in the form of roughly straight lips or fins. These projections 140 were created by bending or otherwise forming a portion of the ring 150 between the middle diameter 160 and the inner diameter 154 to point perpendicular to the plane of the ring 150. The projections 140 are of a size that can fit into the notches 126, 130 of the notched members.

In the embodiment shown, the ring 150 has a portion 162 cut away to form a C-shaped body. This embodiment is particularly suitable for passing the suspension ring 150 into a hole having a diameter less than the outside diameter 152 from below as long as the cut away portion 162 is larger than the thickness of the ceiling tile or other surface. Such a shape is not necessary if the suspension ring 150 is to be installed from above the ceiling tile.

Figure 2:
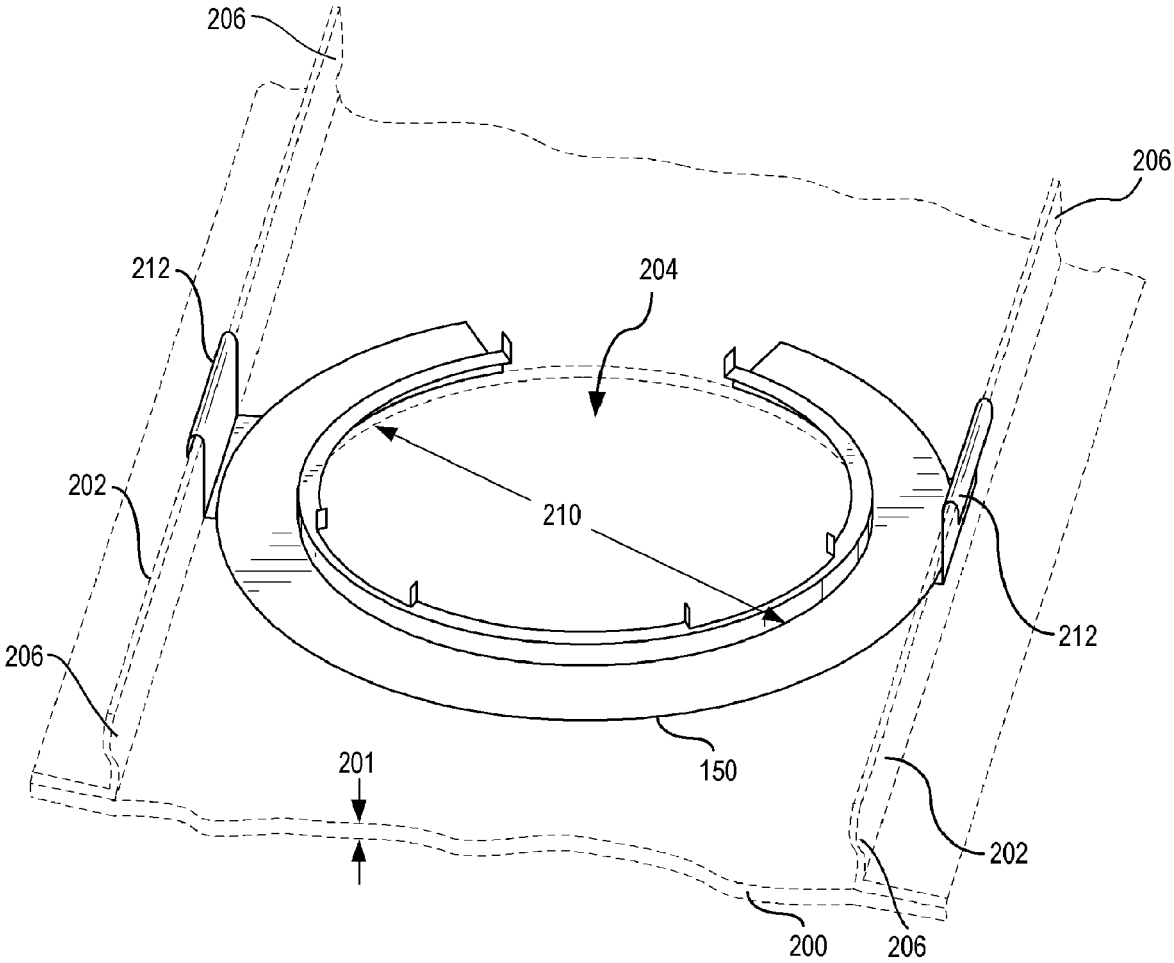
FIG. 2 is an illustration of a suspension ring installed in a ceiling tile in accordance with an embodiment of the present invention.

FIG. 2 shows an illustration of a suspension ring 150 installed in a ceiling tile 200 having a thickness 201 and a hole 204 with a hole diameter 210 in accordance with an embodiment of the present invention. In the embodiment shown, the ceiling tile 200 is not structurally strong enough to bear the weight of the speaker assembly 100. To support this weight, the suspension ring 150 is attached to two suspension rails 202 located above the ceiling tile. The suspension rails 202 are a long member with an L-shaped cross-section and a hook 206 at each end for hanging on the support frame (not shown) that holds the ceiling tile 200. The suspension rails 202 have a cross section that is smaller than the hole diameter 210. The suspension ring 150, due to its C shape and the suspension rails 202 can be passed through the hole 204 in the ceiling tile 200 from below.

The suspension ring 150 is provided with two hooks 212 for engaging with the suspension rails 202 as shown. In an alternative embodiment, the hooks 212 may be replaced with some other fastening mechanism such as sheet metal screws.

In the embodiment shown, it should be noted that the middle diameter 160 of the suspension ring 150 and the hole diameter 210 are roughly equivalent. However, this is not necessary and the two diameters 150, 210 may vary significantly as long as their respective relationships with the other diameters (e.g., the relationships between the middle ring diameter 160 and the clamp diameter 138, the hole diameter 210 the outside housing diameter 106, the hole diameter 210 the outside ring diameter 152, and the inside diameter 154 and the outside housing diameter 106) are not affected.

It should be pointed out that if the ceiling tile were constructed of metal, wood or some other material capable of bearing the weight of the speaker assembly 100 and suspension ring 150, then the ring 150 could be installed above the hole 204 without the use of the suspension rails. In an embodiment, the suspension ring 150 is provided with a roughened or high-friction surface so that when the speaker assembly 100 is installed and the clamps 120 are tightened, the suspension ring is fixed to the ceiling tile 200.

Figure 3A:
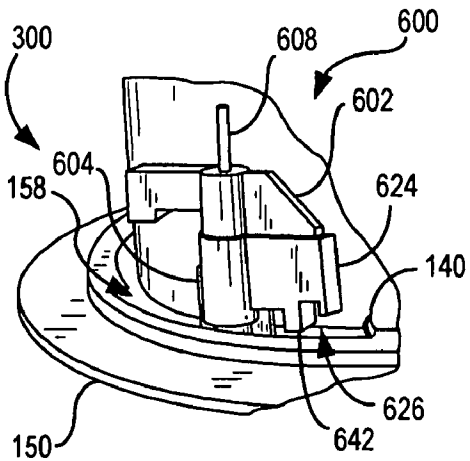
FIGS. 3A-3C are a set of illustrations of suspending the speaker assembly by rotation of the assembly after insertion into the ceiling tile and installed suspension ring shown in FIG. 2 in accordance with an embodiment of the present invention.
Figure 3B:
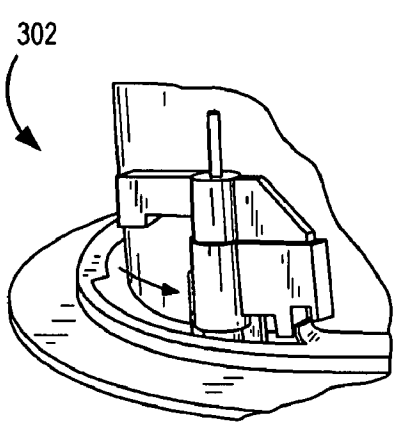
Figure 3C:
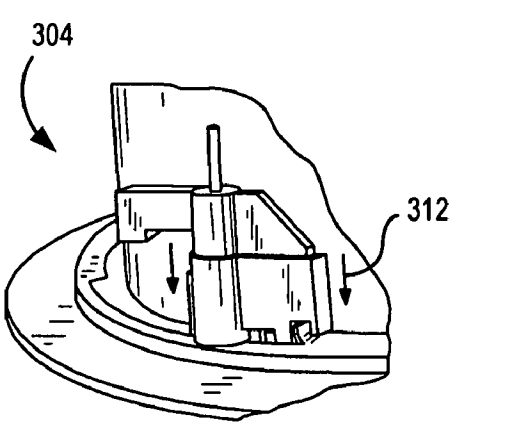

FIGS. 3A-3C are illustrations of suspending the speaker assembly 100 by rotation of the assembly 100 after insertion into the hole 204 of the ceiling tile 200 of a first thickness and the installed suspension ring 150 as shown in FIG. 2 in accordance with an embodiment of the present invention. In the embodiment shown, an installer has cut a circular hole 204 into the ceiling tile 200, passed the suspension ring 150 and suspension rails 202 through the hole 204 from below and installed the ring 150 and rails 202 as shown in FIG. 2. The speaker assembly 100 in FIGS. 3A-3C is arbitrarily shown with clamps 600 having a T-shaped member 602, an inner member 604, a screw 608 and an enclosed spring (not shown) matching the embodiment shown in FIG. 6.

Next, the speaker assembly 100 has been passed from below through the ceiling tile 200 and the suspension ring 150. The speaker assembly 100 is inserted in a first position 300 (FIG. 3A) relative to the suspension ring 150 so that the clamps 600 are aligned with and pass through the voids 158. This is possible because the middle ring diameter 160 is at least slightly greater than the clamp diameter 138.

After insertion, the speaker assembly 100 is rotated, in the embodiment shown, clockwise to an intermediate position 302 relative to the suspension ring 150. This rotation is possible because the distance 136, (see FIG. 5), from the housing flange 108 and the first notched member 624 is greater than the thickness of the ceiling tile 200 plus the height of the projection 140. In the intermediate position 302 (FIG. 3B), the first notched members 624 of the clamps 600 are now aligned so that the first notches 626 are over a first set of projections 140. In the embodiment shown, rotation is stopped when the stopper portion 642 contacts the projection 140.

After rotation, the speaker assembly 100 is lowered without rotation into a second position 304 (FIG. 3C) where the notches 626 of the clamps 600 are engaged with the first set of projections 140. In this second position 304, the weight of the speaker assembly 100 is carried by the suspension ring 150 and the installer no longer need to hold the speaker assembly 100 in place. Furthermore, because the notches 124 are engaged with the projections 140, the speaker assembly 100 is prevented from further rotation and thus from falling onto the installer inadvertently.

The installer now has both hands free to manipulate the fasteners 134 and tighten 312 the clamps 600 into a position that fixes the speaker assembly 100 to the suspension ring 150. In the embodiment shown, the fastening is achieved by rotation of the screw fasteners 608 to move the clamps 600 closer to the housing flange 108. This fixes the speaker assembly 100 in the second position 304.

Figure 4A:
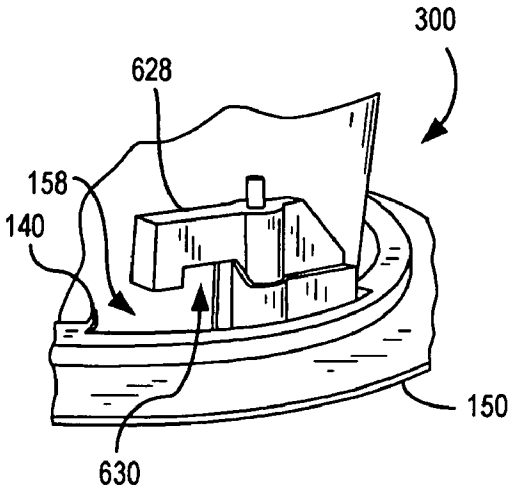
FIGS. 4A-4C are another set of illustrations of suspending the speaker assembly by rotation of the assembly after insertion into the ceiling tile and installed flange shown in FIG. 2 in accordance with an embodiment of the present invention.
Figure 4B:
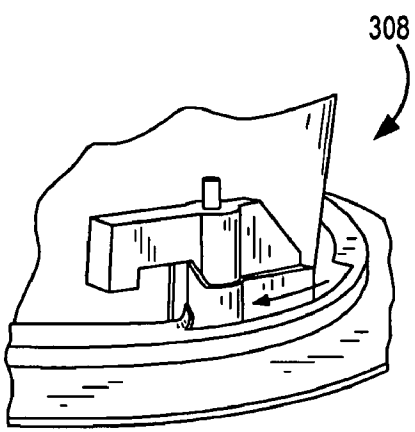
Figure 4C:
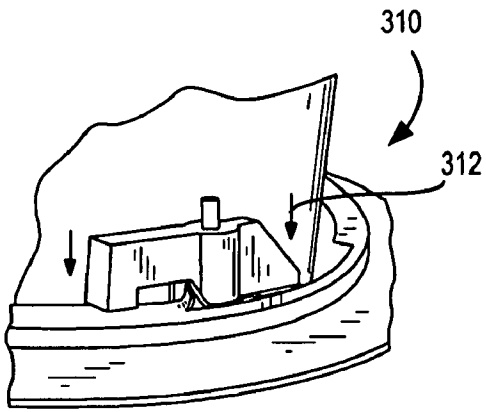

FIGS. 4A-4C is another illustration of suspending the speaker assembly shown in FIG. 3A-3C by rotation of the assembly after insertion into the ceiling tile 200 and installed suspension ring 150. However, in the embodiment shown in FIGS. 4A-4C, the thickness 201 of the ceiling tile 200 is greater than the maximum distance 136 (see FIG. 5) between the first notched member 624 of the clamp 600 and the flange end of the clamp 600. Therefore, the speaker assembly 100 can not be rotated clockwise from the first position 300 (FIG. 4A) into the intermediate position 302 shown in FIG. 3B.

In FIG. 4A, the second notched member 628 is located at a second distance 137 from the flange end of the clamp 600 that is greater than the distance 136 from the first notched member 124 and the flange end (see FIG. 5). If the total distance 137 between the second notched member 128 and the housing flange 108 is greater than the thickness 201 of the ceiling tile plus the height of the projections 140, then the speaker assembly may be rotated counter-clockwise into another intermediate position 308 (FIG. 4B) relative to the suspension ring 150. In this intermediate position 308, the second notched members 628 of the clamps 600 are now aligned so that the second notches 630 are over a second set of projections 140 as shown.

After rotation, the speaker assembly 100 is lowered without rotation into a third position 310 (FIG. 4C) where the notches 630 of the clamps 600 are engaged with the second set of projections 140. In this third position 310, the weight of the speaker assembly 100 is carried by the suspension ring 150 and the installer no longer need to hold the speaker assembly 100 in place. Furthermore, because the notches 624 are engaged with the projections 140, the speaker assembly 100 is prevented from further rotation and thus from falling onto the installer inadvertently.

The installer now has both hands free to manipulate the fasteners 608 and tighten 312 the clamps 600 into a position that fixes the speaker assembly 100 to the suspension ring 150 in the third position 310. In the embodiment shown, the fastening is achieved by rotation of the screw fasteners 608 to move the clamps 600 closer to the housing flange 108.

The contrasting FIGS. 3A-3C and 4A-4C illustrate why the notched members 624, 628 are located at different distances from the flange end of the clamp 600. As discussed above, rotation of the screw fastener 608 changes the distance 136 between the notched members 624, 628 and the housing flange 108. A minimum for the distance 136 is that between the first notched member 624 and the flange end 132 of the clamp 600. A maximum for the distance 136 is the distance between the second notched member 628 and the flange end 632 of the clamp 600 plus the maximum displacement of the flange end 632 of the clamp 600 from the housing flange 108 possible by the fastener 608. The speaker assembly 100 is capable of being installed in a ceiling tile having a thickness between these two extremes, less of course the height of the projections 140 which must be cleared when rotating the speaker assembly 100 out of the first position 300.

The first notched member 624 is generally located between 0 mm and 50 mm from the flange end 632 and more preferably located between 3 mm and 10 mm (measured from the flange end 632 to the notched member 624, with the depth of the notch 626 itself ranging between 2 mm and 10 mm and being most preferably roughly equivalent to the height of the projection 140) in order to allow the speaker assembly to be easily installed in the most common standard ceiling tile which is 16 mm thick based on a 5 mm high projection 140. The second notched member 628 is located at a distance ranging between 0 mm and 300 mm greater than the distance between the first notched member 624 and the flange end 632, and ranging more preferably between 10 mm and 50 mm and most preferably between 15 mm and 35 mm greater than the distance between the first notched member 124 and the flange end 632.

By providing a clamp 600 with opposing notched members at different distances from the flange end 632, the speaker assembly 100 is adaptable to be used for standard 16 mm ceiling tiles while still being suitable for non-standard ceiling tile thicknesses. More particularly, one embodiment of the present invention is suitable for use with ceiling tiles greater than 5 mm and less than 45 mm in thickness. Thus, considering that the clamps may be tightened via manipulation of the fasteners 608, the clamps 600 allow the speaker assembly 100 to be fixedly installed in ceiling tiles with a range of thicknesses from 1 mm to slightly less than the distance between the second notched member 628 and the flange end 632 plus the maximum extension away from the housing flange 108 allowed by the fastener 608.

Figure 7:
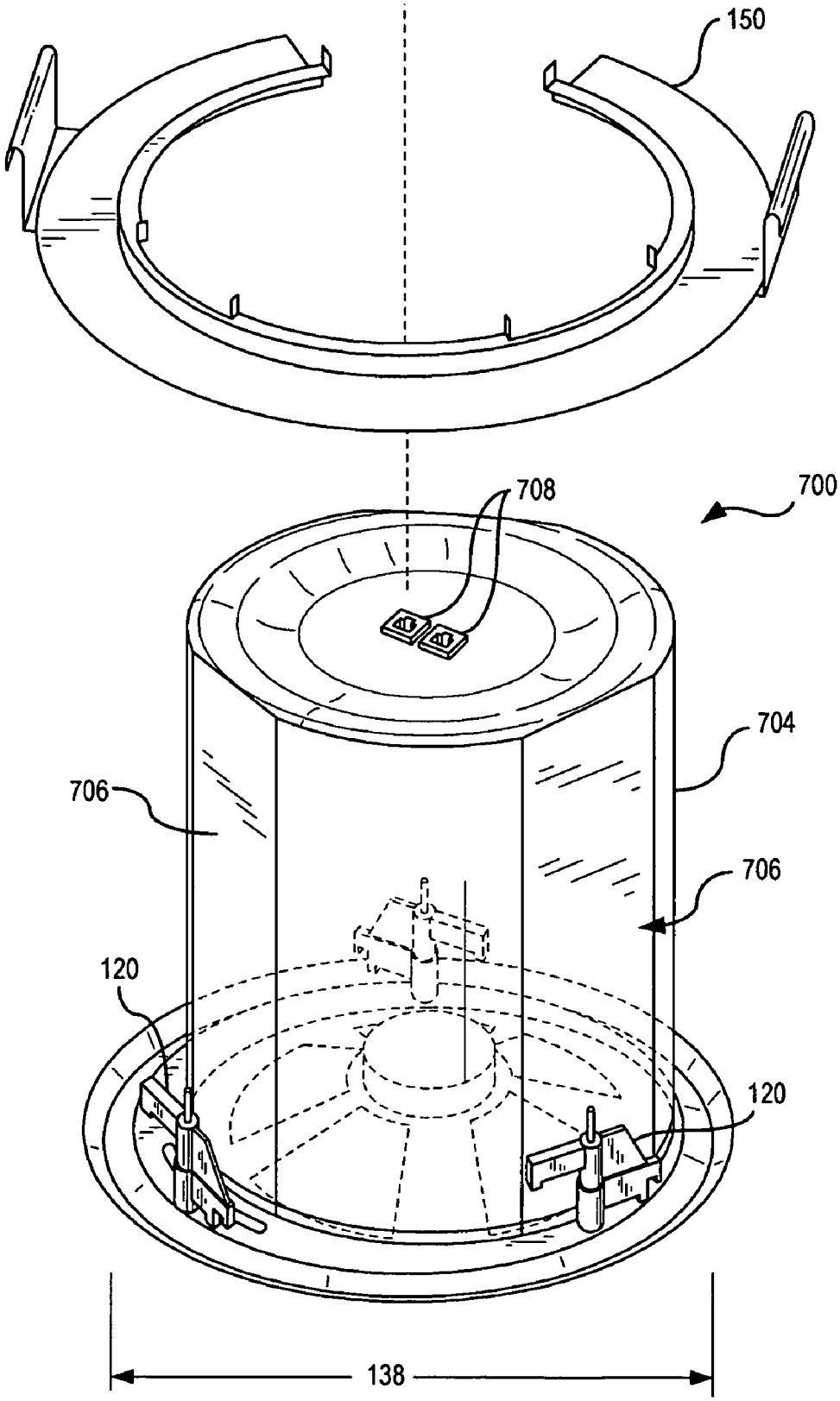
FIG. 7 shows another embodiment of a speaker assembly in accordance with an embodiment the present invention.

FIG. 7 shows an alternative embodiment of a speaker assembly 700 in which the housing 704 is roughly cylindrical but also provided with flat surfaces 706 adjacent to the clamps 120. The flat surfaces 706 provide additional clearance between the clamps 120 and the housing 704 without increasing the clamp diameter 138.

The embodiment in FIG. 7 also illustrates one possible configuration for electronic connections to the speaker assembly 700. The illustration shows two connectors 708 in the housing 704. In the embodiment power may be provided via one connector and the signal may be provided by the other. Alternative configurations and connectors are also possible and within the scope of the invention.

It should be noted that the selection of shapes and attachment means described above are illustrative only, and are not intended to limit the invention. For example, it is within the scope of this invention to provide a housing flange of any shape, a speaker of any shape, a ceiling tile hole of any shape and a suspension ring of any shape as long as the functional aspects of penetration, rotation and engagement between the parts are maintained. One skilled in the art will realize that any suitable electronics that can be associated with a speaker system can be housed in the housing 104. For example, in one embodiment, the housing 104 includes a transceiver for receiving data via wireless transmission. In another embodiment, the housing 104 includes an amplifier for amplifying the signal received and/or a digital to analog converter for receiving digital signals.

One skilled in the art will also realize that various speaker configurations are also possible. For example, in an embodiment a mesh speaker cover is provided that, when installed, hides the clamp fasteners and speaker from view. The mesh speaker cover also protects the covered speaker from damage. The speaker cover removably engages the housing flange via bayonet fasteners. In the embodiment a volume control is provided that is accessible from below when the mesh speaker cover is removed.

While the invention has been described in detail and with reference to specific embodiments thereof, it will be apparent to those skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A speaker assembly for mounting through a surface having a hole, the speaker assembly comprising:

a speaker attached to a mounting plate, the mounting plate having one or more mounting clamps movably connected thereto;

a bracket having one or more first flanges, each of the first flanges corresponding to one of the plurality of mounting clamps;

wherein, the one or more mounting clamps are movably engagable with the first flanges to provide a gravity-secured engagement; and wherein, the one or more mounting clamps are securable in relation to the first flanges by movement of each of the one or more mounting clamps in relation to the mounting plate.

2. The speaker assembly of claim 1 wherein the bracket is c-shaped.

3. The speaker assembly of claim 1 wherein the one or more clamps are provided with notched members for movably engaging the first flanges.

4. The speaker assembly of claim 1 wherein the one or more clamps are engaged by inserting the clamps into the mounting plate and rotating the speaker relative to the mounting plate.

5. The speaker assembly of claim 1 wherein the speaker assembly is mounted to the surface by inserting a portion of the speaker through the hole and the bracket.

6. The speaker assembly of claim 5 wherein, when the speaker assembly is mounted, the surface is between the mounting plate and the bracket.

7. The speaker assembly of claim 4 wherein the one or more clamps may be engaged by rotating the speaker clockwise or counter clockwise.

8. The speaker assembly of claim 1 wherein each of the one or more clamps comprises:

a notched member movably engaging one of the first plurality of flanges; and a fastener penetrating the mounting plate and the notched member, manipulation of the fastener moving the notched member relative to the mounting plate.

9. The speaker assembly of claim 8 wherein the fasteners may be manipulated by an installer while the speaker is in a gravity-secured engagement with the bracket.

10. A method of installing an assembly in a horizontal ceiling tile comprising:

cutting a circular hole having a hole diameter in the ceiling tile;

placing a suspension ring above the ceiling tile concentric with the circular hole, the suspension ring having an inner diameter less than the hole diameter but greater than an assembly diameter, the suspension ring provided with a plurality of voids corresponding to a plurality of clamps attached to the assembly allowing the assembly and attached clamps to penetrate the suspension ring when the assembly is in a first position relative to the suspension ring;

penetrating from below the hole and the suspension ring with the assembly and attached clamps in the first position; and rotating and lowering the assembly to a second position relative to the suspension ring in which a first notch on at least one of the plurality of clamps engages one of the plurality of projections whereby the housing rests on the suspension ring and is prevented from rotation into the first position without first raising the housing.

11. The method according to claim 10 further comprising:

releasing the assembly to rest by gravity in the second position.

12. The method according to claim 10 further comprising:

tightening the fasteners to secure the clamps on the suspension ring with the projections engaged in the notches of the clamps, thereby fixing the assembly to the ceiling tile.

13. The method according to claim 10, wherein the suspension ring is provided with an opening to form a "C"-shape and wherein the opening includes one of the plurality of voids corresponding to the plurality of clamps and placing further comprises:

passing the suspension ring through the ceiling tile from below by penetrating the opening with a portion of the ceiling tile.

14. The method according to claim 13 further comprising:

installing supports to a frame supporting the ceiling tile; and fixing the suspension ring to the supports.

15. The method of claim 10 further comprising:

if a thickness of the ceiling tile is greater than a predetermined amount, counter-rotating and lowering the assembly to a third position relative to the suspension ring in which a second on at least one of the plurality of clamps engages one of the plurality of projections whereby the housing rests on the suspension ring and is prevented from rotation into the first position without first raising the housing.

16. A speaker assembly for mounting through a surface having a width via a hole, the hole having a hole diameter and the speaker assembly comprising:

a speaker penetrating an attached housing flange, the housing flange having a center axis and an outside flange diameter greater than the hole diameter, a portion of the speaker extending beyond the housing flange and having a outside housing diameter; and a plurality of clamps, each clamp movably attached by a fastener to the housing flange at a clamp diameter less than the hole diameter;

wherein each clamp includes at least one notched member extending substantially parallel to the housing flange including a first notched member, each notch of the at least one notched member opening toward the housing flange and each notch for engaging one of a plurality of projections on a suspension plate, the suspension plate having an opening with an inner diameter greater than the outside housing diameter but less than the clamp diameter, the suspension plate provided with a plurality of voids corresponding to the plurality of clamps and shaped to allow the portion of the speaker and attached clamps to penetrate the suspension plate;

the speaker assembly having:

a first position relative to the suspension plate in which the portion of the speaker and clamps may be inserted through the hole into the opening of the suspension plate such that the portion penetrates the suspension plate and the clamps penetrate the voids; and a second position relative to the suspension plate, the second position achieved by vertically inserting the portion and clamps upward into the suspension plate, rotating the speaker assembly about the center axis and lowering the speaker assembly, in which at least one notch on the plurality of clamps engages one of the plurality of projections whereby the speaker assembly rests under gravity on the suspension plate and is prevented from rotation into the first position without first raising the speaker assembly.

17. The speaker assembly in accordance with claim 16, further comprising:

the suspension plate.

18. The speaker assembly in accordance with claim 16, further comprising:

each clamp having a body, the first notched member extending from the body at a first distance from a base of the body, and a second notched member extending from the body opposite the first member at a different second distance from the base of the body and the first notched member including the first notch and the second notched member including a second notch;

wherein the plurality of projections on the suspension plate includes a plurality of first projections and a plurality of second projections;

wherein rotating the speaker assembly clockwise about the center axis and lowering the speaker assembly places the speaker assembly in the second position in which the first notch of each clamp is engaged with one of the plurality of first projections and whereby the speaker assembly rests on the suspension plate and is prevented from rotating into the first position without first being raised; and wherein rotating the speaker assembly counter-clockwise about the center axis and lowering the speaker assembly places the speaker assembly in a third position relative to the suspension plate wherein the second notch of each clamp is engaged with one of the plurality of second projections and whereby the speaker assembly rests on the suspension plate and is prevented from rotation into the first position without first raising the speaker assembly.

19. The speaker assembly in accordance with claim 16, wherein working the fastener for each clamp moves the clamp in a direction parallel to the center axis between a first clamp position and a second clamp position, the first clamp position having the first notched member at a first distance apart from the housing flange greater than the sum of the surface width and projection height thus allowing the clamps to clear the projections during rotation and the second clamp position having the first notched member at a second distance apart from the housing flange less than the sum of the surface width and projection height thus preventing the rotation of the housing.

20. The speaker assembly in accordance with claim 16, wherein each clamp is provided with a stopper associated with each notch, the stopper preventing rotation of the speaker assembly about the center axis when inserted into the suspension plate by contact with one of the plurality of projections.

21. The speaker assembly in accordance with claim 17, wherein the suspension plate is provided with an opening to form a "C"-shape and wherein the opening includes one of the plurality of voids corresponding to the plurality of clamps.

22. The speaker assembly in accordance with claim 16, wherein adjacent to each void is at least one of the plurality of projections.

23. The speaker assembly in accordance with claim 18, wherein adjacent to each void is a first projection and a second projection, the first projection and second projection being on opposite sides of the void.

24. The speaker assembly in accordance with claim 18, wherein the first distance ranges from 2 millimeters to 10 millimeters and wherein the second distance ranges from 15 millimeters to 35 millimeters greater than the first distance.

25. The speaker assembly in accordance with claim 18, wherein the clamps further comprise:

a spring within the body, the spring applying a spring force between the housing flange and the notched member.

26. A speaker assembly for mounting through a surface having a hole, the speaker assembly comprising:

a speaker attached to a mounting plate, the mounting plate having one or more supporting members, at least one of the one or more supporting members being movably connected to the mounting plate;

a bracket having one or more first flanges, each of the first flanges corresponding to one of the one or more supporting members;

wherein, the one or more supporting members are movably engagable with the first flanges to provide a gravity-secured engagement; and wherein the at least one of the one or more supporting members being movably connected to the mounting plate is securable in relation to the corresponding flange by movement of the supporting member in relation to the mounting plate.

27. The speaker assembly of claim 26, wherein each of the supporting members are movably connected to the mounting plate and are securable in relation to the corresponding first flange by movement of the supporting member in relation to the mounting plate.

28. The speaker assembly of claim 26, wherein the one or more supporting members are movably engagable with the first flanges to provide a gravity-secured engagement via inserting a portion of the speaker into the bracket and rotating the speaker within the bracket.

29. The speaker assembly of claim 28, wherein the one or more supporting members are movably engagable with one or more second flanges on the bracket to provide a gravity-secured engagement via inserting the portion of the speaker into the bracket and counter-rotating the speaker within the bracket.

30. The speaker assembly of claim 28, wherein the portion of the speaker is inserted through the hole in the surface and into the bracket.

31. The speaker assembly of claim 26, wherein the bracket is shaped to allow the bracket to be passed through the hole in the surface.

32. The speaker assembly of claim 29, wherein rotating the speaker within the bracket allows the speaker assembly to be gravity-secured to a surface having a first range of thicknesses and counter-rotating the speaker allows the speaker assembly to be gravity-secured to a surface having a second range of thicknesses.

33. The speaker assembly of claim 32, wherein the first range of thicknesses includes a standard ceiling tile thickness of about 16 millimeters.

34. The speaker assembly of claim 32, wherein the second range of thicknesses includes a surface thickness of about 45 millimeters.

* * * * *